US011224822B2

(12) United States Patent
Kolev

(10) Patent No.: US 11,224,822 B2
(45) Date of Patent: Jan. 18, 2022

(54) FLEXIBLE MODULAR INTERLOCKING CONSTRUCTION DEVICE

(71) Applicant: Nikola Kolev, Marietta, GA (US)

(72) Inventor: Nikola Kolev, Marietta, GA (US)

( * ) Notice: Subject to any disclaimer, the term of this patent is extended or adjusted under 35 U.S.C. 154(b) by 0 days.

(21) Appl. No.: 17/282,643

(22) PCT Filed: Oct. 12, 2019

(86) PCT No.: PCT/US2019/056015
§ 371 (c)(1),
(2) Date: Apr. 2, 2021

(87) PCT Pub. No.: WO2020/077321
PCT Pub. Date: Apr. 16, 2020

(65) Prior Publication Data

US 2021/0354045 A1 Nov. 18, 2021

Related U.S. Application Data

(60) Provisional application No. 62/745,275, filed on Oct. 12, 2018.

(51) Int. Cl.
*A63H 33/16* (2006.01)
*A63H 33/08* (2006.01)

(52) U.S. Cl.
CPC ..... *A63H 33/16* (2013.01); *A63H 33/08* (2013.01)

(58) Field of Classification Search
CPC ..... A63H 33/08; A63H 33/16
USPC ..... 446/109, 114, 115, 116, 478, 487, 488
See application file for complete search history.

(56) References Cited

U.S. PATENT DOCUMENTS 2,936,939 A * 5/1960 Lundquist ..... B65D 5/00 229/116
3,359,657 A * 12/1967 Hedberg ..... B29C 53/06 434/211
3,447,733 A * 6/1969 Nelson ..... B65D 5/5475 229/120.011
3,665,669 A 5/1972 Huber
3,666,607 A * 5/1972 Weissman ..... B65D 5/427 428/33
3,895,229 A 7/1975 Strom
(Continued)

*Primary Examiner* — Joseph B Baldori
(74) *Attorney, Agent, or Firm* — Diament Patent Law, P.C.; Adam Diament

(57) ABSTRACT

A flexible modular construction device comprising tongue portions (26) and flap portions (18) extending from a polygonal body (12). The polygonal body and flap portions have openings (16; 22) which are similar in size and shape, such that the tongue portion can engage said openings simultaneously. Slits (24) between the polygonal body and flap portions allow the tongue of other construction modules to pass through and engage with the openings of overlapping flap and body portions on other modules in an interweaving manner. The margin between body portions, flaps, and tongues is marked with integral hinges (14; 20; 28) which allow the user to assemble stellated forms and other articulated and convertible geometric structures. Accordingly several advantages are to provide an improved construction device, to provide means of increasing the ease of assembling more structurally stable forms, using a more user-friendly and versatile modular construction device.

8 Claims, 8 Drawing Sheets

(56) References Cited

U.S. PATENT DOCUMENTS 4,454,678 A * 6/1984 Duvivier ..... A63H 33/105 446/112
4,976,652 A 12/1990 Schwartz
5,002,224 A 3/1991 Muise
5,125,565 A 6/1992 Rogers
5,171,014 A * 12/1992 Hsieh ..... A63F 9/12 273/157 R
5,372,450 A * 12/1994 Blodgett ..... A63H 33/10 403/171
5,400,918 A * 3/1995 Prodaniuk ..... B31D 5/0086 220/677
5,489,230 A * 2/1996 Gavula, Jr. ..... A63H 33/16 428/33
5,597,112 A * 1/1997 Knapp ..... B65D 5/029 229/109
5,662,508 A 9/1997 Smith
5,878,940 A 3/1999 Rosenbalm
6,179,681 B1 * 1/2001 Matos ..... A63H 33/084 446/101
7,389,908 B2 * 6/2008 Cohen ..... B65D 5/008 206/459.5
9,339,735 B2 * 5/2016 Morris ..... A63H 33/16
11,110,368 B2 * 9/2021 Nawracala ..... A63H 33/044
2004/0046011 A1 * 3/2004 Lin ..... B65D 5/0085 229/116
2004/0182741 A1 9/2004 Goers et al.
2006/0219764 A1 * 10/2006 Copeman ..... B65D 5/0254 229/116.1
2008/0149694 A1 6/2008 Lee et al.
2010/0178839 A1 * 7/2010 Khattah Omar ..... A63H 33/084 446/120
2011/0281705 A1 11/2011 Aganovic et al.
2012/0309258 A1 12/2012 Hawthorne
2017/0239587 A1 8/2017 Ericksen

* cited by examiner

FLEXIBLE MODULAR INTERLOCKING CONSTRUCTION DEVICE

CROSS-REFERENCE TO RELATED APPLICATIONS

This application is a national stage application, filed under 35 U.S.C. § 371 of International Application No. PCT/US2019/056015, filed Oct. 12, 2019, which claims benefit of and priority to U.S. Provisional Patent Application No. 62/745,275, filed Oct. 12, 2018, the contents of each are incorporated by reference in their entireties.

FIELD OF THE INVENTION

The invention relates to a modular construction device designed to join with other construction devices to form a variety of three-dimensional structures.

BACKGROUND

Puzzles and constructor sets have existed for a long time. Some products in this field have attempted to solve the problem of designing a construction element that can be assembled with other such construction elements to form three-dimensional forms. However, I have found that each of these products has its shortcomings, which leads me to believe that there is opportunity for innovation in the field.

Modular origami paper folding, or kusudama, has existed for centuries. Many enthusiasts create forms from folded, and sometimes cut, repeating modules. Folding each unit by hand is a time-consuming and laborious process. For example, a stellated form with 90 pieces could take days to complete. For that reason, making and exploring modular origami forms is only reserved for true enthusiasts. Furthermore, forms constructed from paper are fragile and susceptible to the elements, making repeat assembly and disassembly not a viable option.

U.S. Patent Publication no. US20170239587A1 to Sven Kristian Frederick ERICKSEN entitled Construction Unit refers to "a construction unit configured to interlock with other construction units to create a variety of different shapes." In this publication, the geometry of the form is obscured by over-pronounced lobes and the assembled structure appears flimsy or lacking dimensional stability.

U.S. Pat. No. 4,976,652A to Idan Schwartz entitled Flat handcraft construction element with slot and opposed tabs refers to "A handcraft construction element comprising a substantially square central engagement portion defining a diagonal slit therethrough and two oppositely disposed triangular integral flaps extending on opposite sides of said engagement portion and hinged therefrom by integral hinges, wherein each of said flaps defines an extended tongue adapted to engage said diagonal slit of another such element; and a sheet having a plurality of handcraft construction elements pre-cut for punching out." This construction unit is limited in the variety of forms which can be assembled. The tongue described herein is a hook-like element which only provides unidirectional resistance and produces limited stability. Furthermore, hook-like engagement elements can be difficult to engage and disengage within the tight margin of an assembled three-dimensional structure.

U.S. Pat. No. 3,895,229A to Holger Strom entitled Hollow shell-like bodies and element for use in construction of same refers to "flexible sheet elements for use in the construction of hollow shell like bodies . . . " In order to construct these shell-like bodies you must handle many flexible sheet elements simultaneously, making assembly difficult and confusing for some. Furthermore, the assembled bodies lack structural rigidity.

SUMMARY OF THE INVENTION

A flexible modular construction device made from flat sheet material which can be assembled with other devices to form a superstructure. The module has a central engagement portion defined by one or more polygon panels. At least one of said polygon panels has at least one centrally located opening. At least one flap portion extends from one or more sides of the polygon panels and is integrally hinged to that polygon panel. Said flap portion has at least one opening. A centrally located slit is positioned between each flap portion and that flap portion's adjoining polygon panel. At least one tongue portion extends from the polygon panels. The tongue is adapted to sequentially engage the slit, the flap portion opening, and the one polygon panel opening of identical modules, whereby a plurality of construction devices may be assembled in a variety of configurations to form three-dimensional bodies.

DRAWINGS

Figure 8:
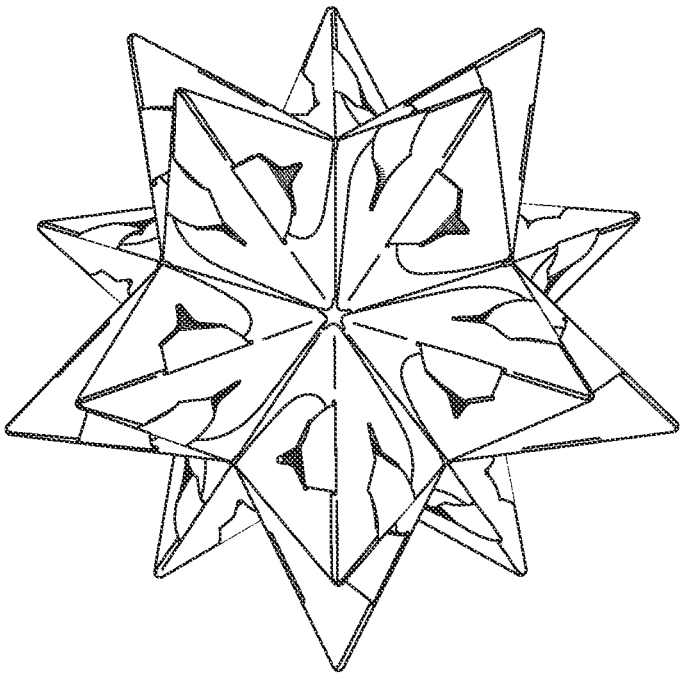

FIG. 8. is a front perspective view of a stellated body assembled from 30 embodiments 100.

Figure 9:
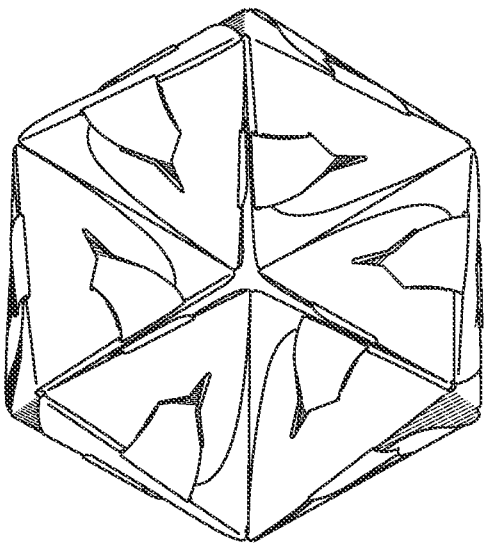

FIG. 9. is a top perspective view of a flexible body assembled from 12 embodiments 100.

DETAILED DESCRIPTION

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein.

Several advantages of one or more aspects are as follows: to provide a construction element that makes assembly and disassembly faster and easier by means of following a simple order of operations, that allows users to sculpt and assemble devices without the necessity of a pre-prescribed end form, that makes the exploration of geometric forms more accessible and economically viable, that can be repeatedly bent and creased without tearing, that is more versatile, that makes possible the assembly of more structurally stable three-dimensional forms, that makes possible the assembly of flexible and convertible structures. These and more benefits of one or more aspects will become apparent from a study of the following description and accompanying drawings.

Figure 1:
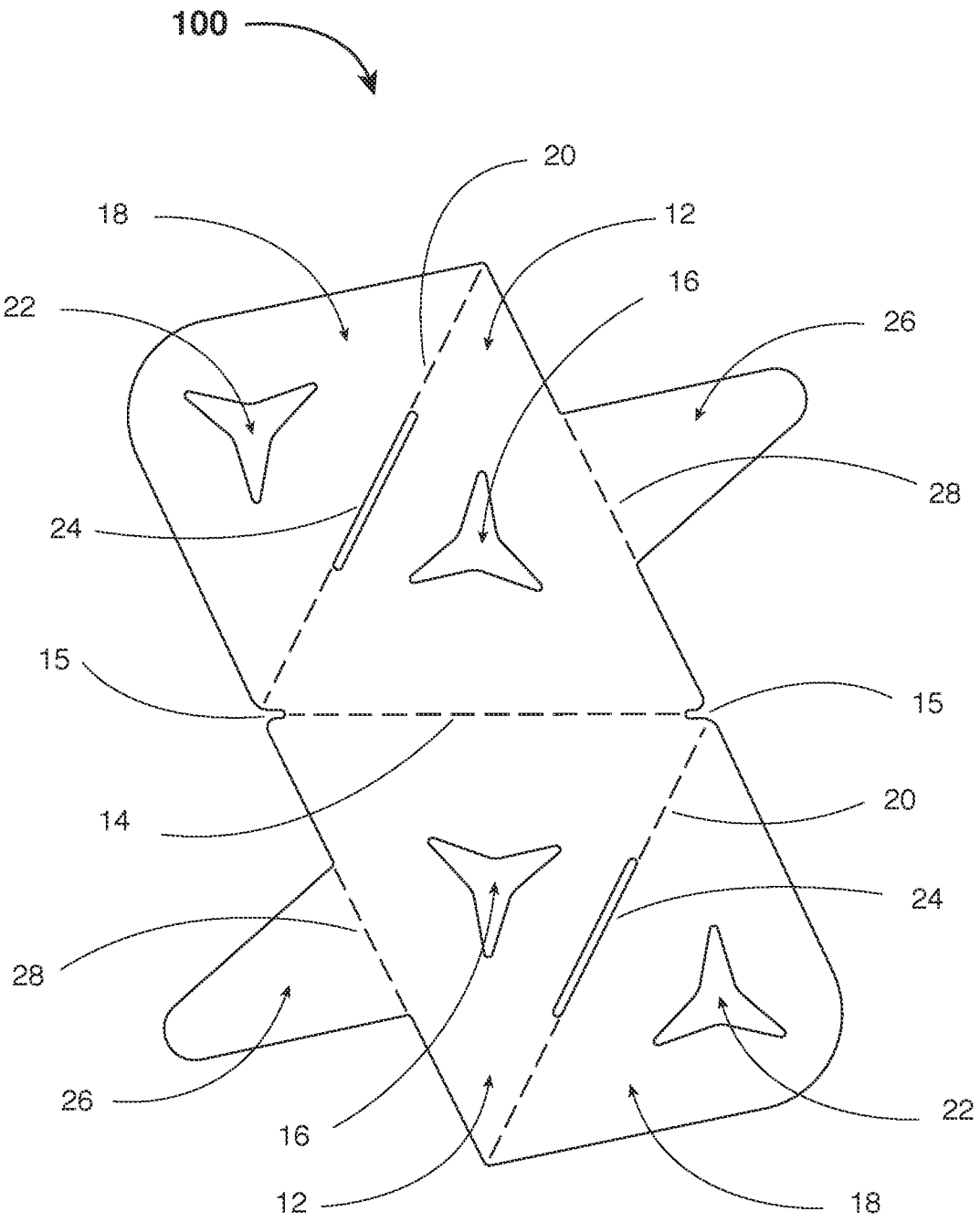
FIG. 1 is a plan view in detail of a first embodiment 100.

FIG. 1 is a plan view of a first embodiment 100. Such devices can be made from polypropylene film or sheeting or other flat material with translucency which is capable of flexure and repeated creasing without tearing, such as synthetic paper, and be cut and creased using a die cutter, laser cutter, or separated from sheet material via a template or other means. Central engagement portion panels are defined by two oppositely disposed isosceles triangles 12 with height equal to their base. The central engagement portion panels 12 share an integral hinge 14 and indentions 15 providing additional flexibility for the construction of convertible geometric structures, such as the one shown in FIG. 9. The central engagement portion panels 12 have openings 16. Flaps 18 and tongues 26 extend from the central engagement portion and are hinged therefrom by integral hinges 20 and 28, respectively. Slits 24 near the margin between the central engagement portion and flap portions are large enough to allow tongue 26 to fully penetrate a slit. Openings 16 and 22 are just big enough to allow tongue 26 to engage. Openings 16 and 22 are triangular star-shaped openings with three outer limit points where the opening is widest, and three inner limit points where the opening is narrowest. The inner limit points on openings 16 and 22 improve tightness and dimensional stability to assembled structures by exerting centrally disposed static resistance to tongues 26 when said tongues of devices are interpenetrating said openings of other such devices. Tongues 26 and openings 16 are symmetrically disposed in relation to the center perpendicular of integral hinge 28, while flaps 18, openings 22, and slits 24 are symmetrically disposed in relation to the center perpendicular of integral hinge 20. The symmetrical design in combination with reversible integral hinges allows for reversibility and thus provides additional versatility in form construction. Internal and external corners of embodiments are slightly rounded to improve the tactile experience during assembly.

Figure 2:
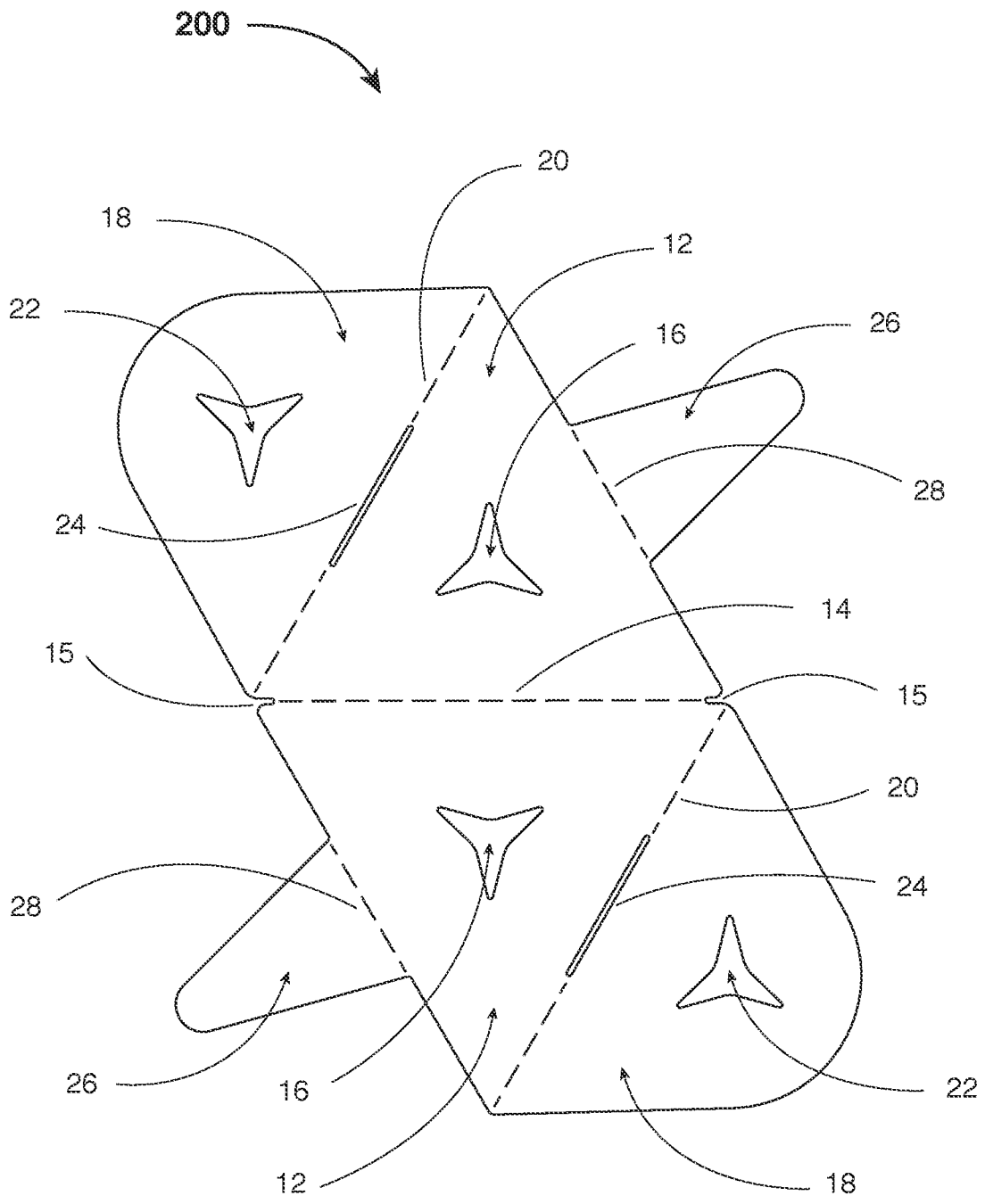
FIG. 2 is a plan view in detail of a second embodiment 200.

FIG. 2 is a plan view of a second embodiment 200. In this embodiment, two central engagement portion panels are defined by two oppositely disposed equilateral triangles 12. The central engagement portion panels share an integral hinge 14 and indentions 15 providing additional flexibility. The central engagement portion panels 12 have openings 16. Flaps 18 and tongues 26 extend from the central engagement portion panels and are hinged therefrom by integral hinges 20 and 28, respectively. Slits 24 near the margin between the central engagement portion and flap portions are large enough to allow tongue 26 to fully penetrate the slit. Openings 16 and 22 are just big enough to allow tongue 26 to engage. Openings 16 and 22 are triangular star-shaped openings with three outer limit points where the opening is widest, and three inner limit points where the opening is narrowest. The inner limit points on openings 16 and 22 improve tightness and dimensional stability to assembled structures by exerting centrally disposed static resistance to tongues 26 when said tongues of devices are interpenetrating said openings of other such devices. Tongues 26 and openings 16 are symmetrically disposed in relation to the center perpendicular of integral hinge 28, while flaps 18, openings 22, and slits 24 are symmetrically disposed in relation to the center perpendicular of integral hinge 20. The symmetrical design in combination with reversible integral hinges allows for reversibility of devices and thus provides additional versatility in form construction.

Figure 3:
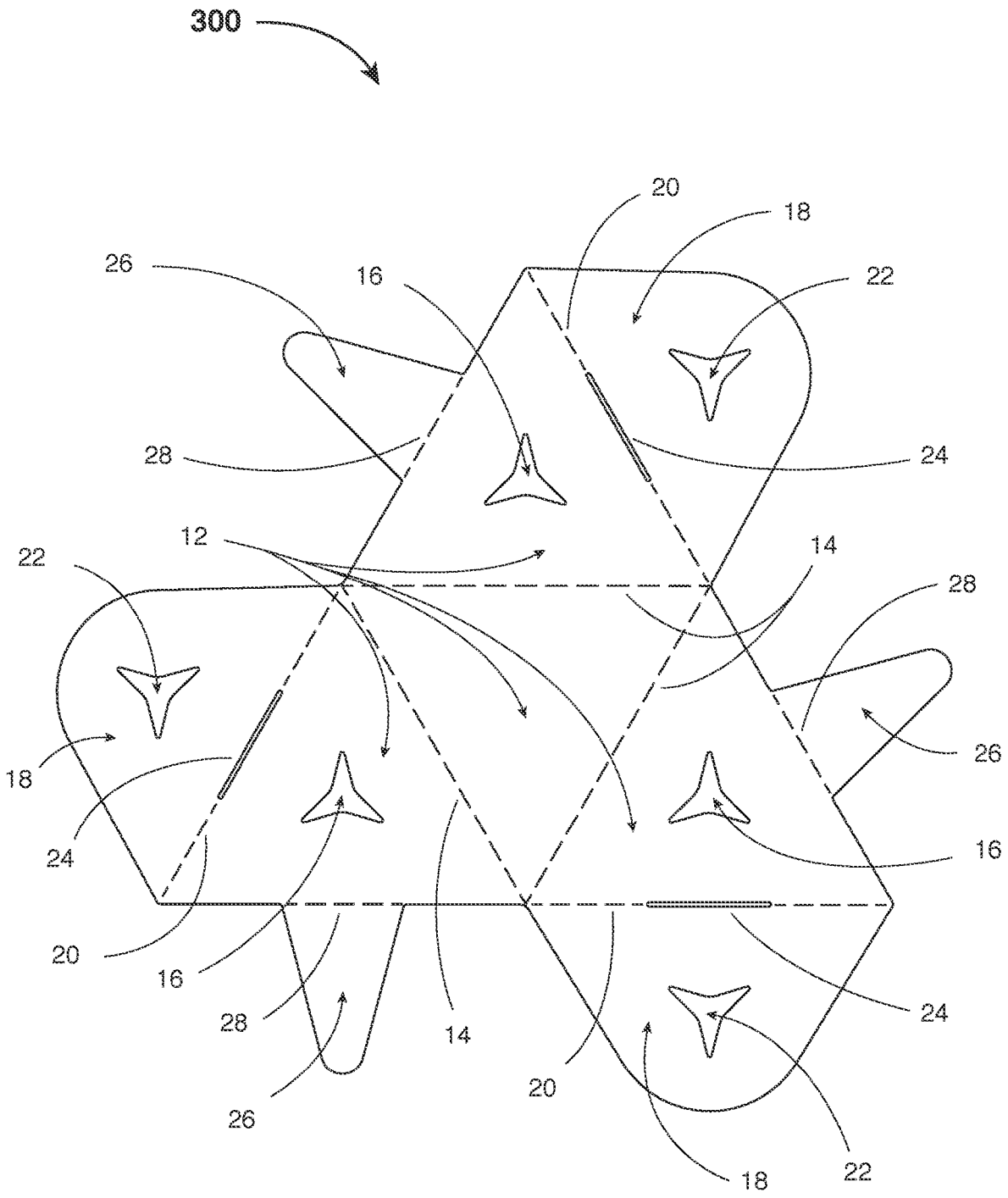
FIG. 3 is a plan view in detail of a second embodiment 300.

FIG. 3 is a plan view of a third embodiment 300. In this embodiment, central engagement portion panels are defined by four equilateral triangles 12. The tree outer central engagement panels 12 have openings 16 and share integral hinges 14 with the inner central engagement panel. Flaps 18 and tongues 26 extend from the three outer central engagement portion panels and are hinged therefrom by integral hinges 20 and 28, respectively. Slits 24 near the margin between the central engagement portion and flap portions are large enough to allow tongue 26 to fully penetrate the slit. Openings 16 and 22 are just big enough to allow tongue 26 to engage. Openings 16 and 22 are triangular star-shaped openings with three outer limit points where the opening is widest, and three inner limit points where the opening is narrowest. The inner limit points on openings 16 and 22 improve tightness and dimensional stability to assembled structures by exerting centrally disposed static resistance to tongues 26 when said tongues of devices are interpenetrating said openings of other such devices. Tongues 26 and openings 16 are symmetrically disposed in relation to the center perpendicular of integral hinge 28, while flaps 18, openings 22, and slits 24 are symmetrically disposed in relation to the center perpendicular of integral hinge 20. The symmetrical design in combination with reversible integral hinges allows for reversibility of devices and thus provides additional versatility in form construction.

Figure 4:
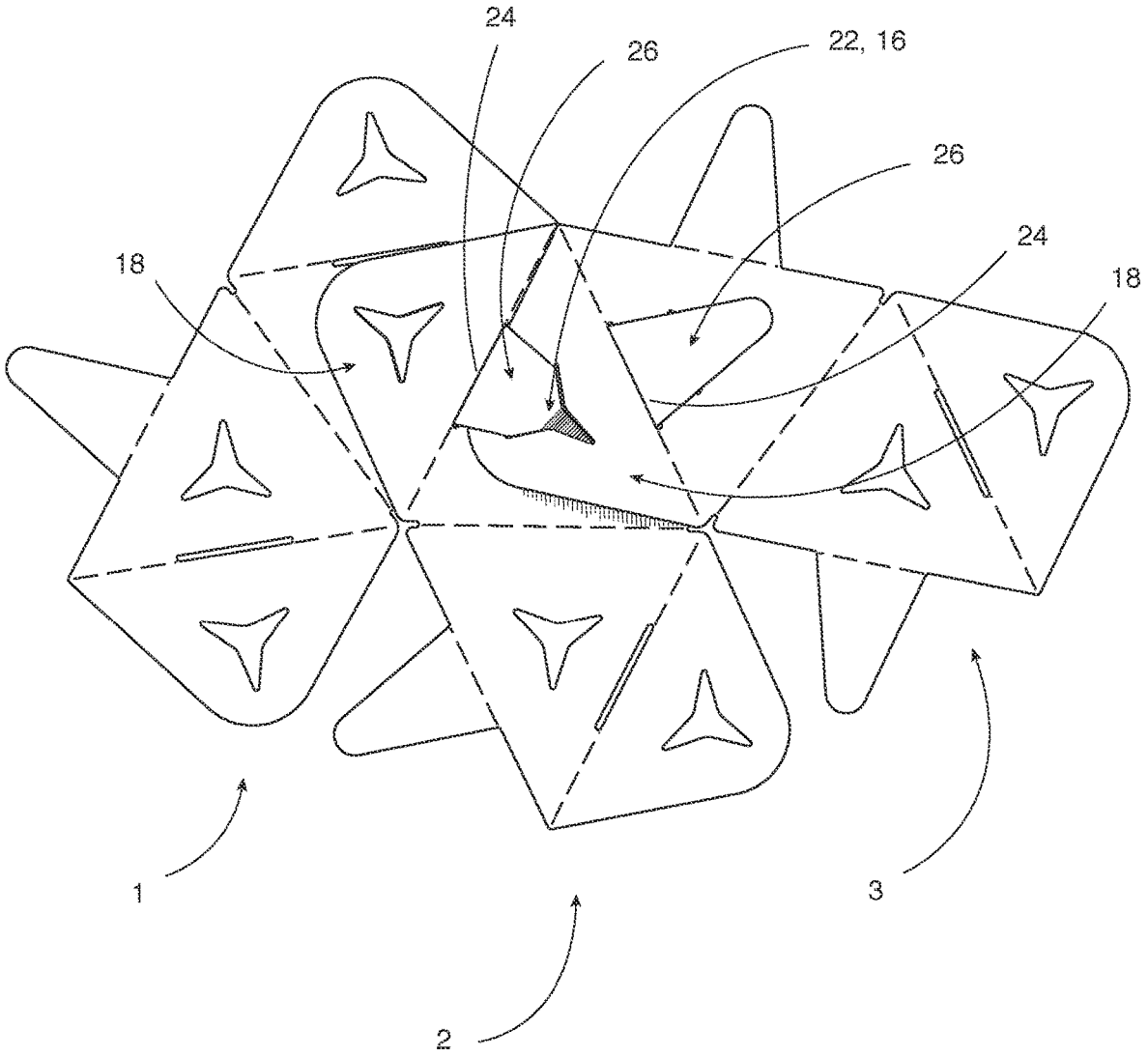
FIG. 4 is a plan view of three identical embodiments 100 joined in accordance with a first assembly pattern.

FIG. 4 is a plan view of three identical embodiments 100. The embodiments are overlapping and releasably joined at the center by interweaving tongue 26 of device 1 under flap 18 of device 2, through slit 24 of device 2, and over and through opening 22 of device 3 and opening 16 of device 2 as the openings overlap. The central engagement portion of device 2 is underneath flap 18 of device 3, while tongue 26 of device 2 passes through slit 24 of device 3 and is above the central engagement portion of device 3.

Figure 5:
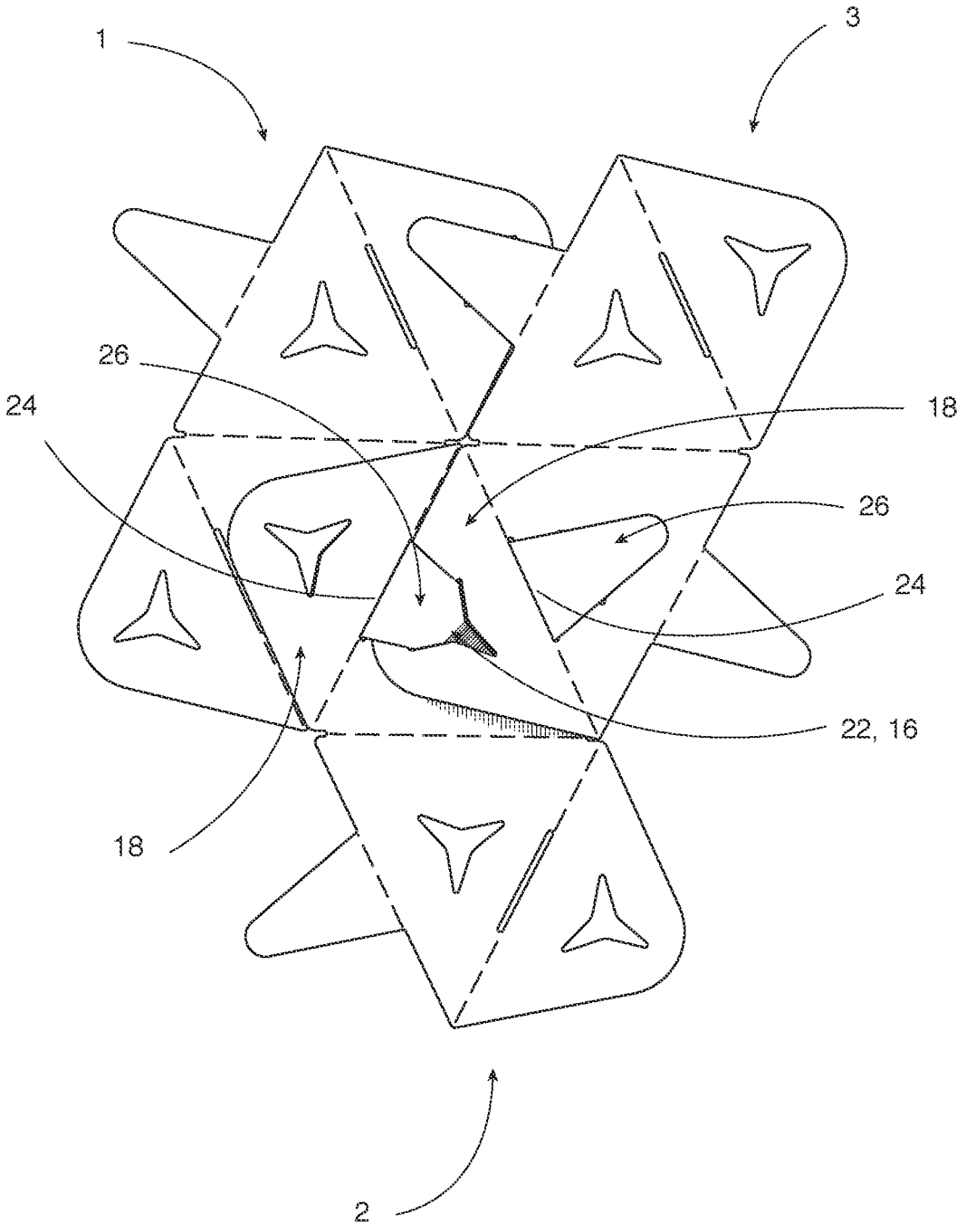
FIG. 5 is a plan view of three identical embodiments 100 joined in accordance with a second assembly pattern.

FIG. 5 is a plan view of three identical embodiments 100. The embodiments 100 are engaged in a way similar to the way described in FIG. 3; however, here device 1 and device 3 are flipped over in relation to device 2. This provides an expanded range of possible construction patterns.

Figure 6:
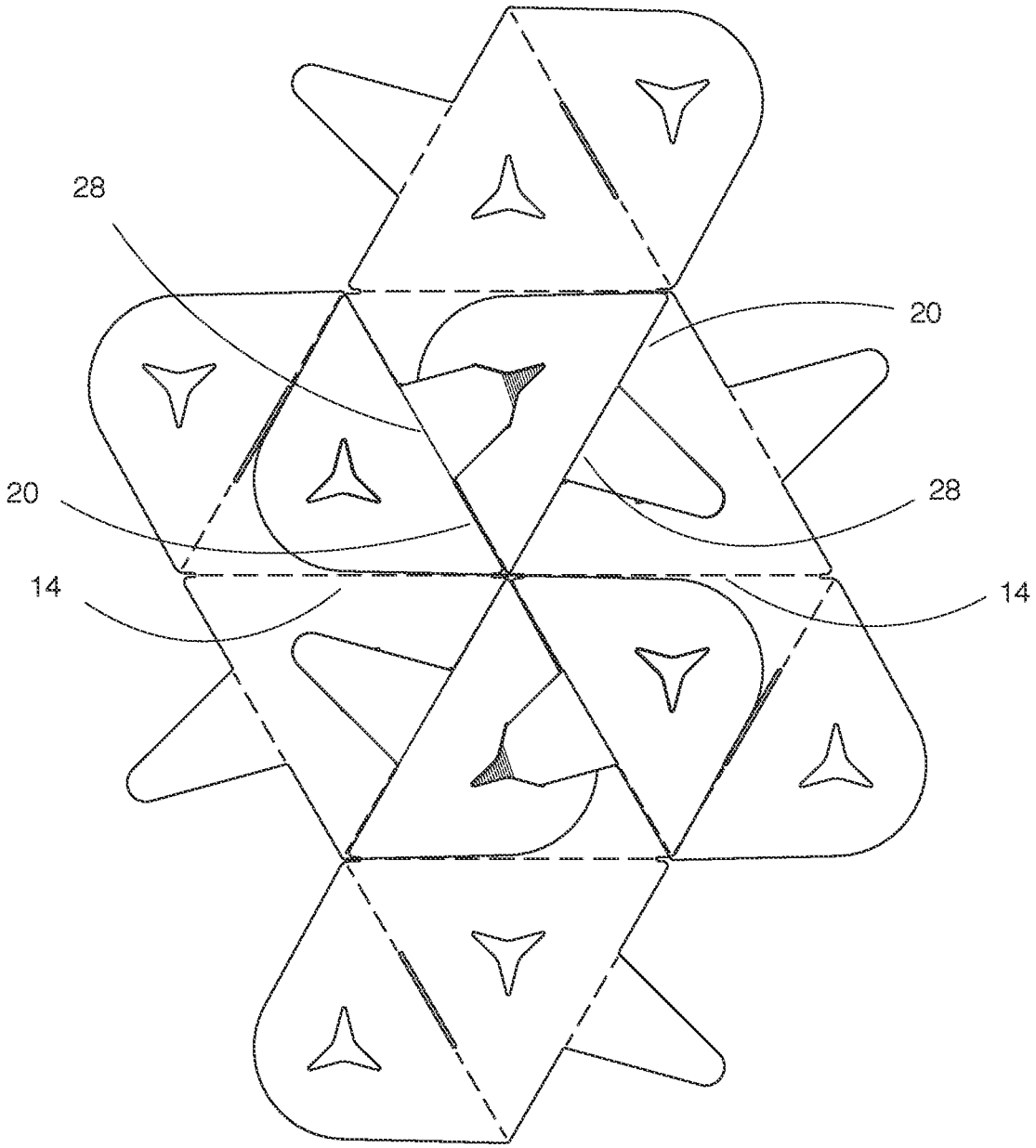
FIG. 6 is a plan view of four identical embodiments 200 joined in accordance with a pattern which allows for the assembly of a flexible tapestry.

FIG. 6 is a plan view of four identical embodiments 200. The embodiments 200 are engaged in a way similar to the way described in FIG. 4. Following this assembly pattern the devices can be joined to form a flexible tapestry which can be flexed and converted in a variety of three-dimensional configurations by activating or inverting integral hinges 14, 20, and 28 in various ways, and/or by adding, removing, or connecting devices together.

Figure 7:
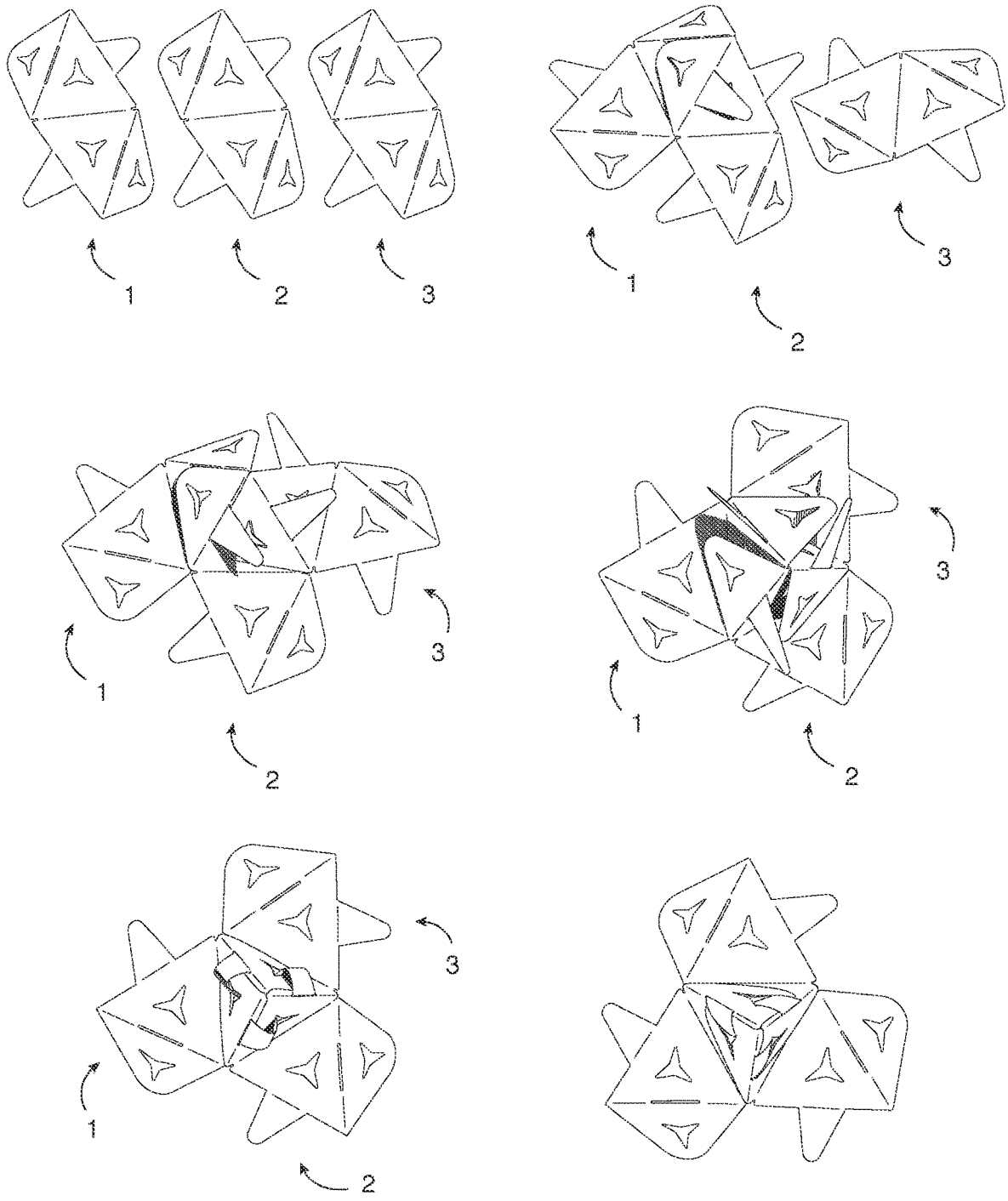
FIG. 7 is a collection of six top perspective views showing three embodiments 100 in a step by step process of an assembly pattern.

FIG. 7 is a collection of six top perspective views of the process of assembling three embodiments 100 in accordance with the pyramidal construction pattern shown in FIG. 4. FIG. 7 shows all three embodiments 100 are creased in identical fashion along integral hinge lines 14, 20, and 28. The devices are assembled by aligning the tongue 26 of each device underneath the flap 18 of its adjoining device and engaging slit 24 of said other device with tongue 26 of the first device. Once three embodiments 100 are engaged in this fashion, flap 18 of each device is folded over the central engagement portion 12 of it's adjoining device and tongue 26 is folded over and bent inward to interpenetrate openings 16 and 22 of its adjoining devices. The process is further explained in the Operation section following this description.

FIG. 8. is a top perspective view of a large stellated dodecahedron constructed from an assembly of 30 embodiments 100 in accordance with the pyramidal construction pattern described in FIG. 4 and FIG. 7. The assembled structure can be internally illuminated through the use of LED lighting. Star shaped projections are produced as a result of a plurality of indentions 15 being arranged in clusters throughout the assembled stellated body. Various other stellated bodies are possible to construct by modifying the assembly pattern and number of devices used.

FIG. 9 is a top perspective view of a constructed body in accordance with one embodiment 100. The form is a convertible assembly of 12 devices following the assembly pattern described in FIG. 5. The structure is capable of inverting. Larger invertible ring-like structures can be constructed by joining additional devices following the same pattern. Forms can be of varying sizes, some forms are constructed of devices with central engagement portion panels 12 measuring 3 cm, while other forms are constructed of devices with central engagement portion panels 12 measuring 10 cm in height. Larger or smaller format structures can be constructed based on the size of the devices used. Bigger units require a thicker and more rigid material in order to retain structural integrity. Thus, the thickness of the device may vary depending on its dimensions. For example, for smaller devices with central engagement portion panels 12, measuring 3 cm or less in height, 6 mil to 8 mil material may suffice; whereas for larger devices with central engagement portion panels 12, measuring 10 cm or more in height, 16 mil to 30 mil material may be better suited to support the rigidity of the assembled structure. The assembled structures can be lit using battery powered LEDs or an electrically powered LED light, as gaps between the assembled units are big enough to accommodate a power cord.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

DRAWINGS—REFERENCE NUMERALS

12 central engagement portion polygon panel
14 integral hinge between central engagement portion polygon panels
15 indention
16 opening of central engagement portion
18 flap portion
20 integral hinge between central engagement portion and flap portion
22 opening of flap portion
24 slit
26 tongue
28 integral hinge between central engagement portion and tongue Operation DFDF One is able to assemble devices into various structural configurations by following a simple order of operations. Consider FIGS. 4, 5, and 7. Take any three devices (1, 2, 3) and insert a tongue of a first device 1 into a slit of a second device 2 so that the flap portion of 2 overlaps the central engagement portion of 1, and insert a tongue of a second device 2 into a slit of a third device 3 so that a flap portion of 3 directly overlaps the central engagement polygon panel of 2. With the opening of the flap portion of device 3 and the opening of the central engagement portion of device 2 aligned, sequentially insert the tongue of device 1 through the overlapping flap portion opening of device 3 and central engagement portion opening of device 2 so that it simultaneously penetrates both openings, and closely secures the flap portion of 3 on top of the central engagement portion of 2.

You can now optionally close the pyramid by repeating the same process when joining the two open ends of the assembly, or introduce additional units to form a more complex configuration. By interweaving pieces together in this fashion, with varying configurations, the user is able to assemble a myriad of three-dimensional structures.

To disassemble, simply disengage the tongues from the openings, and pull the desired pieces apart.

Advantages of the present embodiments over known structures are numerous. The reader will see that one or more aspects of the embodiments of the construction element provide a greater scope for the exploration of a variety of geometric forms. The limits of this versatility are yet to be discovered. Some aspects make possible the assembly of three-dimensional forms with superior structural stability, while also enabling the assembly of flexible and convertible structures. Some aspects increase the ease of assembly and disassembly. Together, the aspects of the embodiments provide a superior modular construction element.

While the above detailed description contains many specificities, these should not be construed as limitations on the scope, but rather as an exemplification of several embodiments thereof. Many other variations are possible. Preferred measurements are disclosed, but the length, width, depth of measures disclosed may also work plus or minus 10%, 25%, 50%, 100%, 200% or more, depending on the size and shape of the three dimensional structure desired. For example, tongue 26 can be of different size, length, or shape as long as slit 24 and openings 16 and 22 are made large enough to accommodate the tongue's passage, yet not too large as to have an excess of space around the tongue once it is fully engaged in the slit and openings. The openings could be of different size, length, or shape as long as they are capable of accommodating the tongue's passage. There could be more than one tongue 26 and more than one flap 18 connected to each central body portion polygon panel 12. The body portion panel 12 could be a differently shaped polygon, such as a square, and there may be a single body portion instead of two body portions within each element. Conversely, there could be a plurality of body portions, tongues, and flap portions such as shown in embodiment 300 that allow the user to fold and fasten a geometric net, defined by the plurality of body portions and integral hinges, into a three-dimensional structure. The elements can be made smaller or larger, and of different materials, and thicknesses. They can be optionally printed on, or otherwise finished in a variety of textures, patterns, and colors.

Accordingly, the scope should be determined not by the embodiments illustrated, but rather by the appended claims and their legal equivalents.

What is claimed is:

1. A foldable device comprising:

a) a central engagement portion defined by at least two polygon panels, wherein said polygon panels are capable of being folded along at least one hinged region, wherein the hinged region is a common edge along the polygon panels, wherein each of said polygons has at least three sides, and wherein the at least one of said polygon panels has at least one opening, wherein the at least one opening is a star-shaped opening having a plurality of outer limit points and a plurality of inner limit points, the at least one opening being widest at the outer limit points and narrowest at the inner limit points;

b) a flap portion extending from at least one side of said polygon panels integrally hinged to the at least one side of said polygon panel, wherein said flap portion has at least one flap portion opening;

c) at least one slit positioned between the at least one flap portion and said flap portion's adjoining polygon panel; and d) at least one tongue portion extending from at least one side of the at least two polygon panels, wherein the at least one tongue is adapted to sequentially engage the at least one slit, the at least one flap portion opening, and the at least one polygon panel opening, whereby a plurality of foldable devices may be assembled in a variety of configurations to form three-dimensional bodies.

2. The foldable device as claimed in claim 1, wherein the flap portion opening is of the same size and shape of the at least one opening of the central engagement portion.

3. The foldable device as claimed in claim 1, wherein the at least two polygon panels are of the same shape and size.

4. The foldable device as claimed in claim 1, wherein the flap portion opening and the at least one polygon panel opening are centrally located within the flap and panel, respectively.

5. The foldable device as claimed in claim 1, wherein one or more edges of said device are slightly rounded.

6. A foldable device comprising:

a) a central engagement portion defined by at least one polygon panel, wherein said at least one polygon panel has at least three sides, and wherein the at least one said polygon panel has at least one opening, wherein the at least one opening is a star shaped opening having a plurality of outer limit points and a plurality of inner limit points, the at least one opening being widest at the outer limit points and narrowest at the inner limit points;

b) at least one flap portion extending from at least one side of the at least one polygon panel integrally hinged to the at least one side of said polygon panel, wherein said flap portion has at least one flap portion opening;

c) at least one slit positioned between the at least one flap portion and said flap portion's adjoining polygon panel; and d) at least one tongue portion extending from at least one side of the at least one polygon panel, whereby the at least one tongue is adapted to sequentially engage the at least one slit, the at least one flap portion opening, and the at least one polygon panel opening, whereby a plurality of foldable devices may be assembled in a variety of configurations to form three-dimensional bodies.

7. The foldable device as claimed in claim 6, wherein the flap portion opening is of the same size and shape of the at least one opening of the central engagement portion.

8. The foldable device as claimed in claim 6, wherein the flap portion opening and the at least one polygon panel opening are centrally located within the flap and panel, respectively.

* * * * *